US011202139B2

(12) United States Patent
Ko et al.

(10) Patent No.: US 11,202,139 B2
(45) Date of Patent: Dec. 14, 2021

(54) SPEAKER UNIT FOR EARPHONE

(71) Applicant: ALMUS Corp., Chungcheongnam-do (KR)

(72) Inventors: Ju Heon Ko, Hwaseong-si (KR); Byung Il Min, Suwon-si (KR); Yun Uk Ha, Incheon (KR); Jeong Kwon Park, Yeoju-si (KR); Yeong Jae Lee, Yongin-si (KR)

(73) Assignee: ALMUS CORP., Chungcheongnam-Do (KR)

( * ) Notice: Subject to any disclaimer, the term of this patent is extended or adjusted under 35 U.S.C. 154(b) by 0 days.

(21) Appl. No.: 16/891,233

(22) Filed: Jun. 3, 2020

(65) Prior Publication Data

US 2021/0289279 A1 Sep. 16, 2021

(30) Foreign Application Priority Data

Mar. 16, 2020 (KR) ..... 10-2020-0031892

(51) Int. Cl.
*H04R 1/10* (2006.01)

(52) U.S. Cl.
CPC ..... *H04R 1/1016* (2013.01)

(58) Field of Classification Search
CPC ..... H04R 1/10; H04R 1/105; H04R 1/108; H04R 1/1008; H04R 1/1058; H04R 1/1016; H04R 1/1066; H04R 1/1075; H04R 1/1083; H04R 1/1091
See application file for complete search history.

(56) References Cited

U.S. PATENT DOCUMENTS

2010/0014703 A1* 1/2010 Wang ..... H04R 9/045 381/398
2012/0275635 A1* 11/2012 Chen ..... H04R 1/1075 381/380
2013/0343595 A1* 12/2013 Zorkendorfer ..... H04R 1/1016 381/380
2014/0133668 A1* 5/2014 Podoloff ..... H04R 1/1041 381/74
2015/0110320 A1* 4/2015 Liu ..... H04R 1/1066 381/322

(Continued)

FOREIGN PATENT DOCUMENTS

KR 10-1956884 B1 3/2019
KR 10-1952909 B1 5/2019
KR 10-2049572 B1 11/2019

*Primary Examiner* — Oyesola C Ojo
(74) *Attorney, Agent, or Firm* — Li & Cai Intellectual Property (USA) Office

(57) ABSTRACT

A speaker unit includes a magnet, an upper plate fixed to a top surface of the magnet, a voice coil disposed to surround outer circumferences of the magnet and the upper plate, a vibration plate to which the voice coil is fixed, a fixing ring on which an edge of the vibration plate is mounted, and a frame having an open top and configured to accommodate the magnet, the upper plate, and the voice coil. Here, a pipe conduit is formed in the frame along a circumferential direction. A first hole configured to come into contact and communicates with a 1_1 space disposed in front of the speaker unit and to allow a 1_2 space disposed on a side of the speaker unit to communicate with the pipe conduit is formed in at least one first position of a side surface of the frame in a circumferential direction.

4 Claims, 19 Drawing Sheets

(56) References Cited

U.S. PATENT DOCUMENTS

| | | | | |
|---|---|---|---|---|
| 2016/0205458 | A1* | 7/2016 | Huang | H04R 1/1016 381/380 |
| 2017/0238088 | A1* | 8/2017 | Wen | H04R 1/1058 381/373 |
| 2021/0136484 | A1* | 5/2021 | Ji | H04R 1/2819 |

* cited by examiner

【FIG.1】
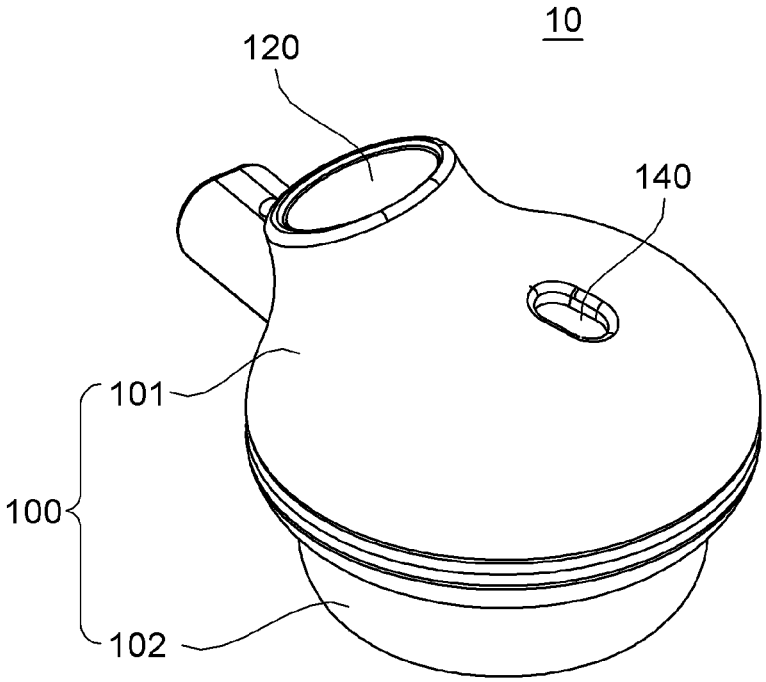

【FIG.2】
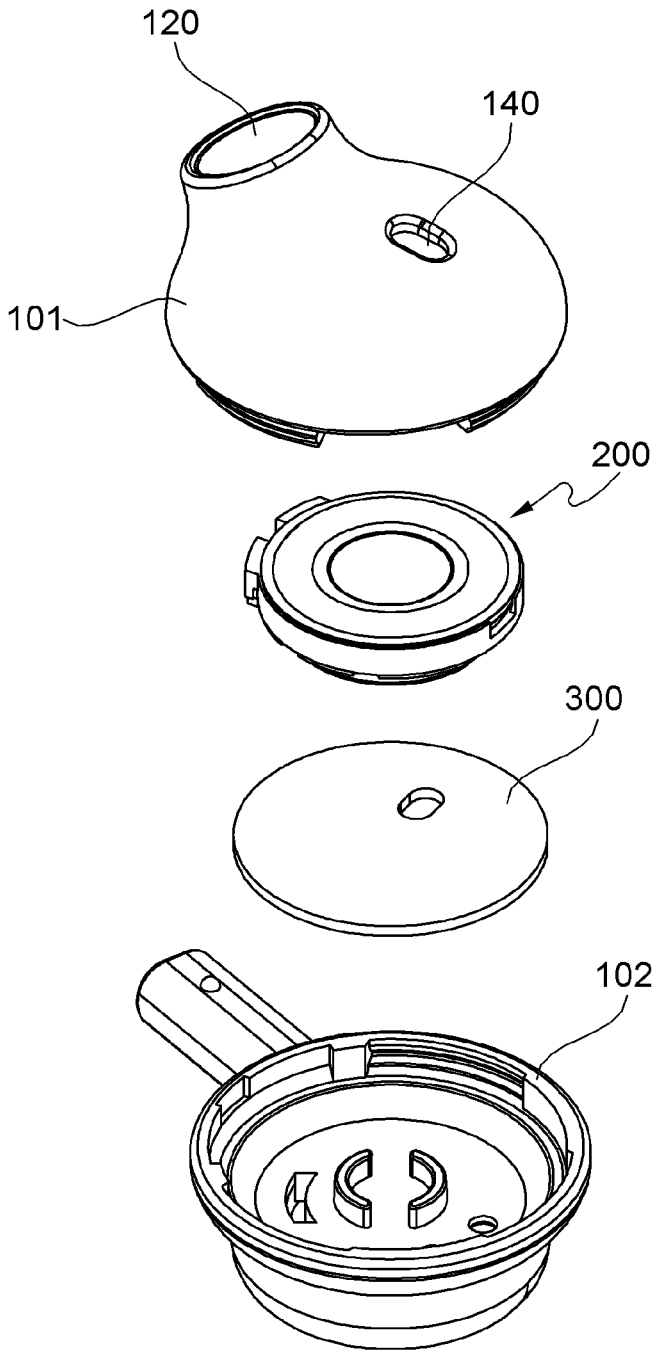

【FIG.3】
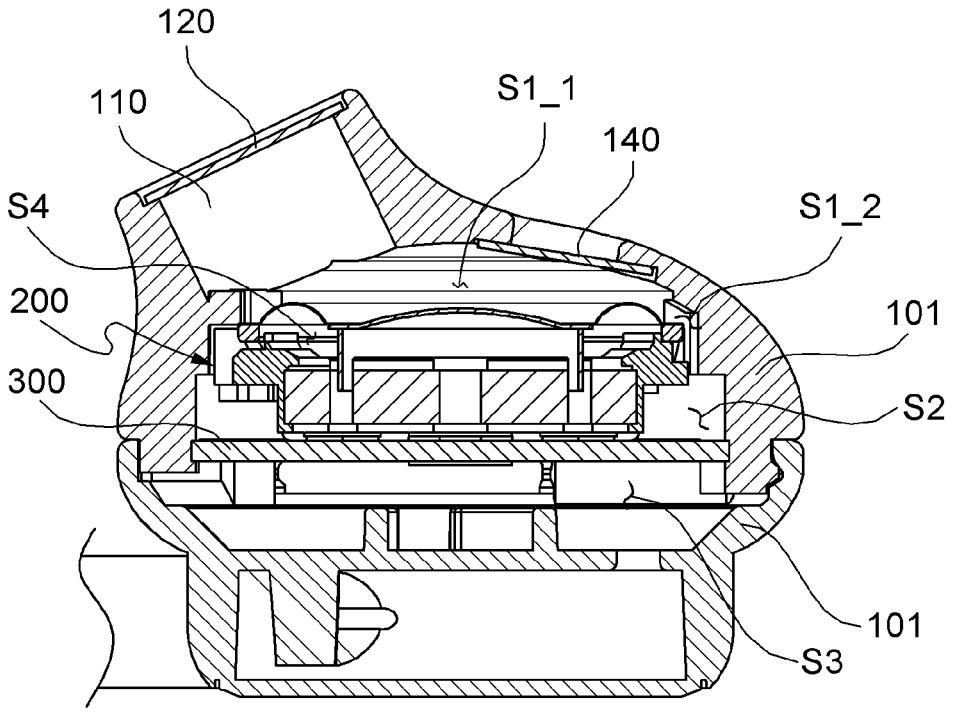

【FIG.4A】
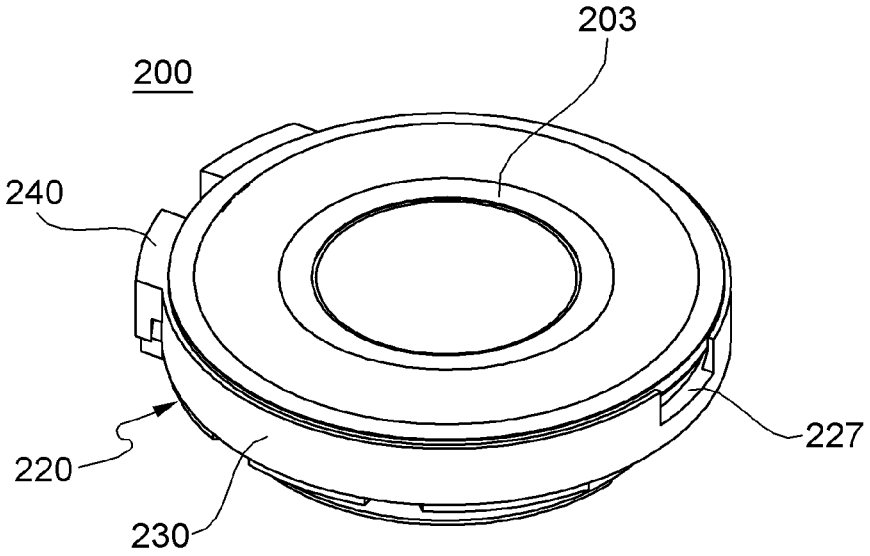

【FIG.4B】
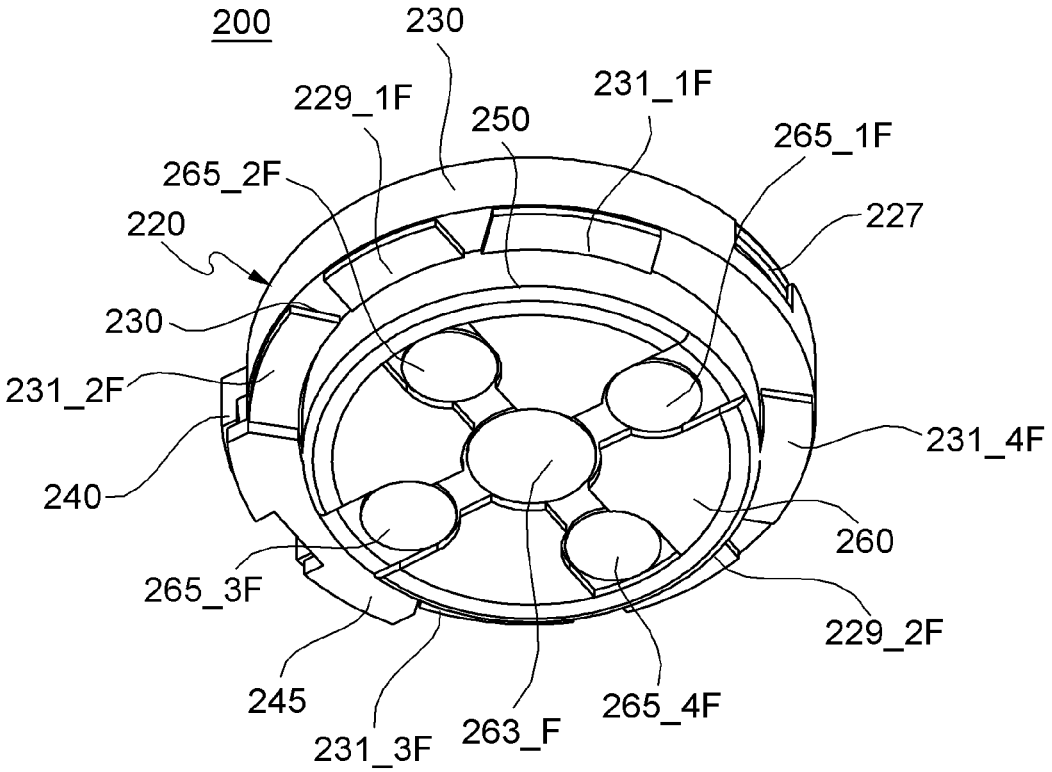

【FIG.5】
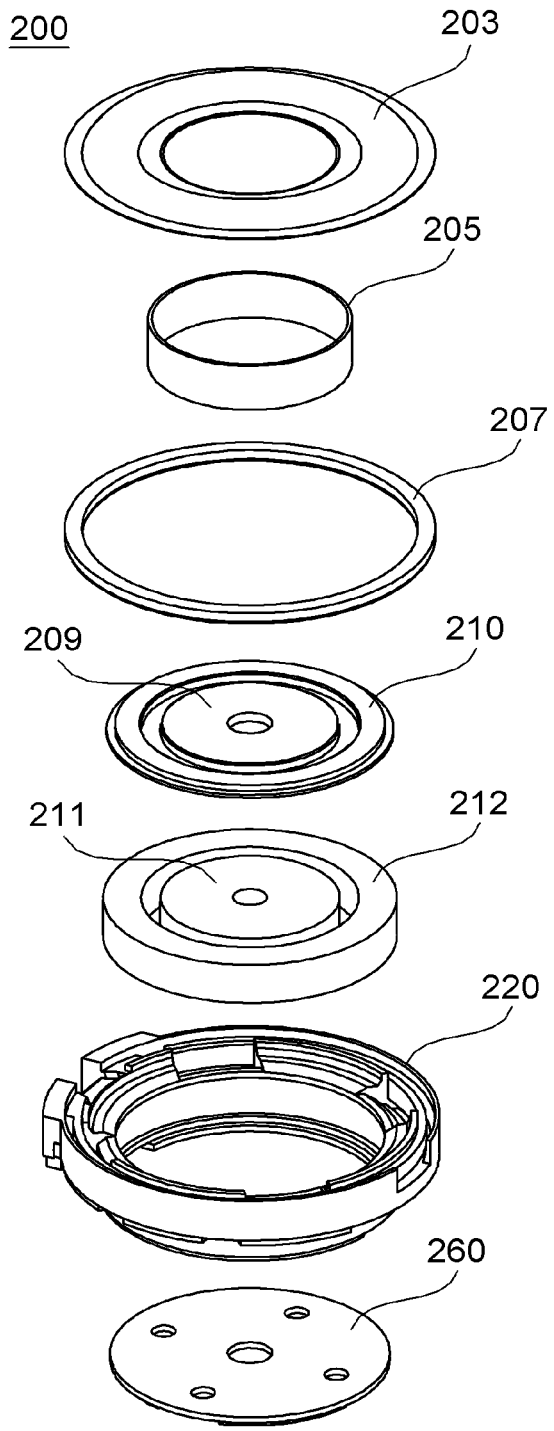

【FIG.6A】
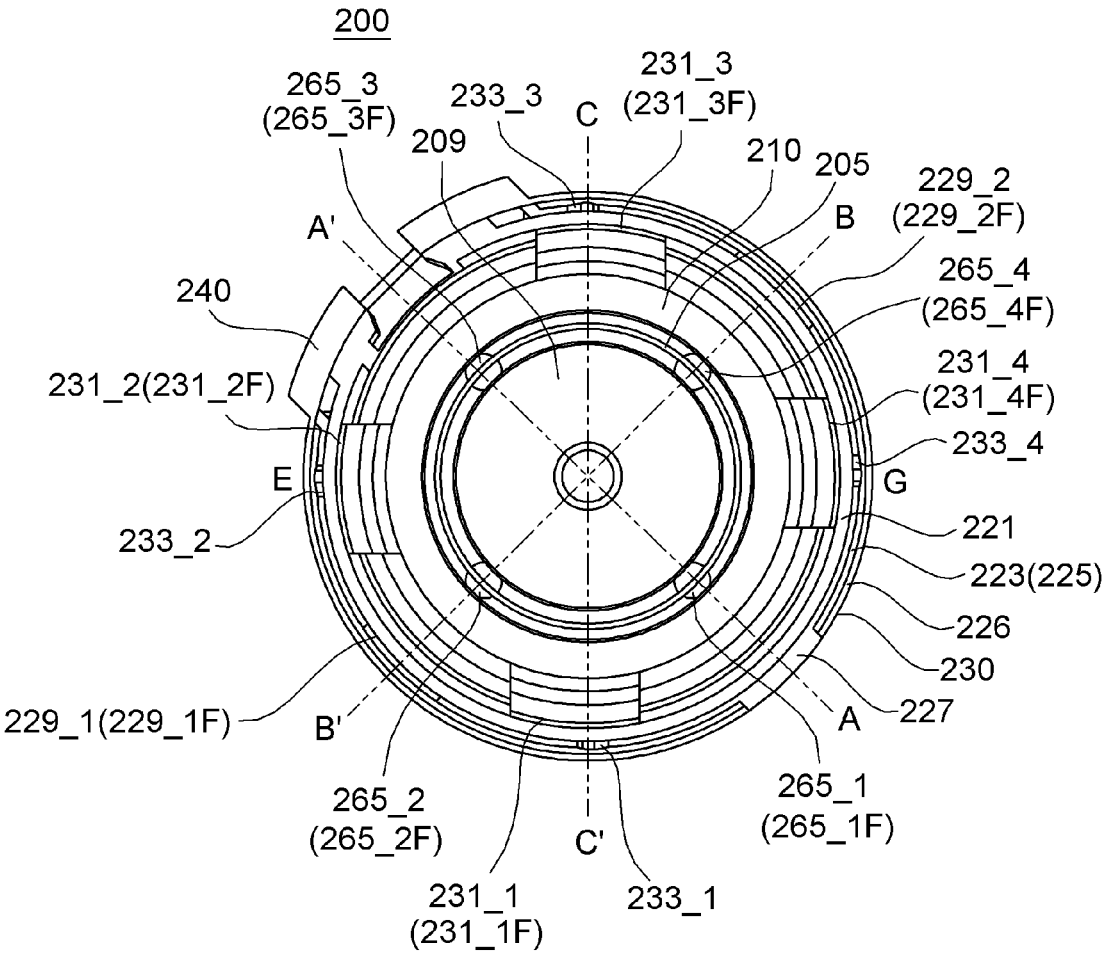

【FIG.6B】
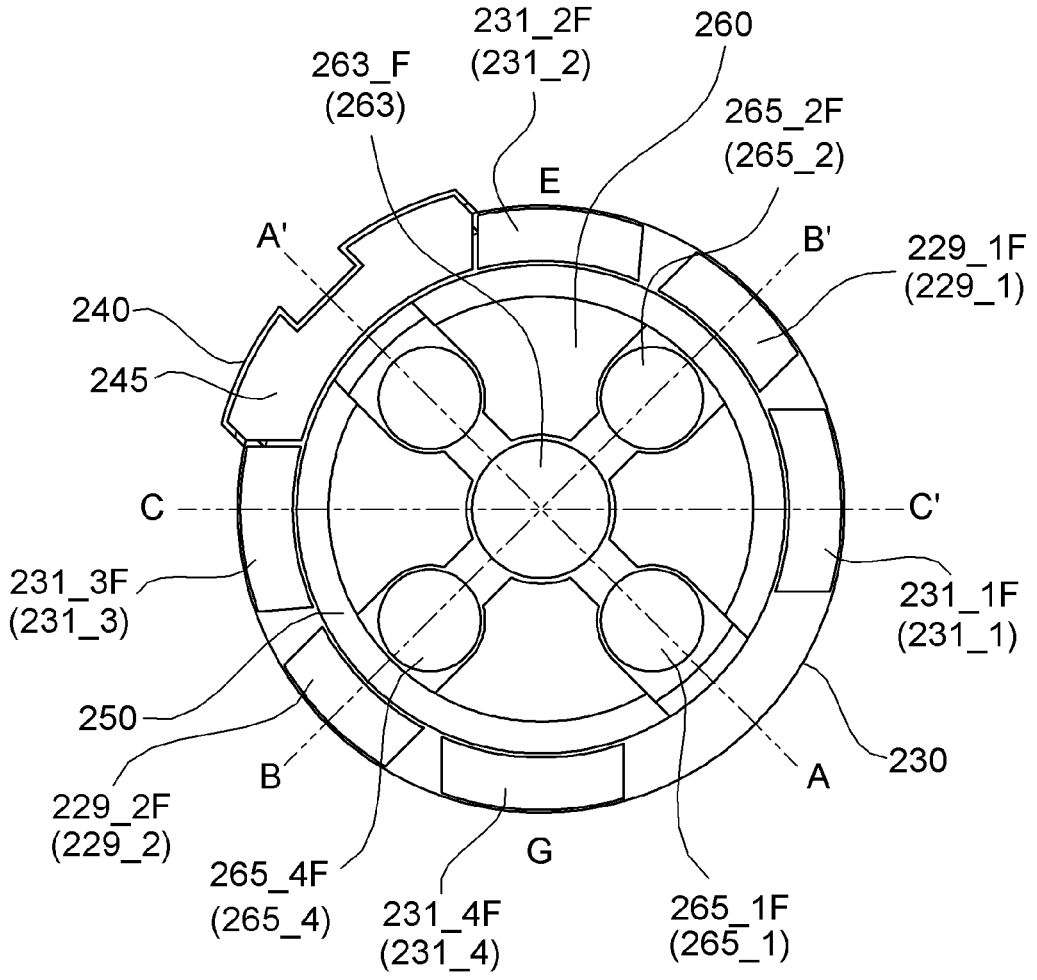

【FIG.7A】
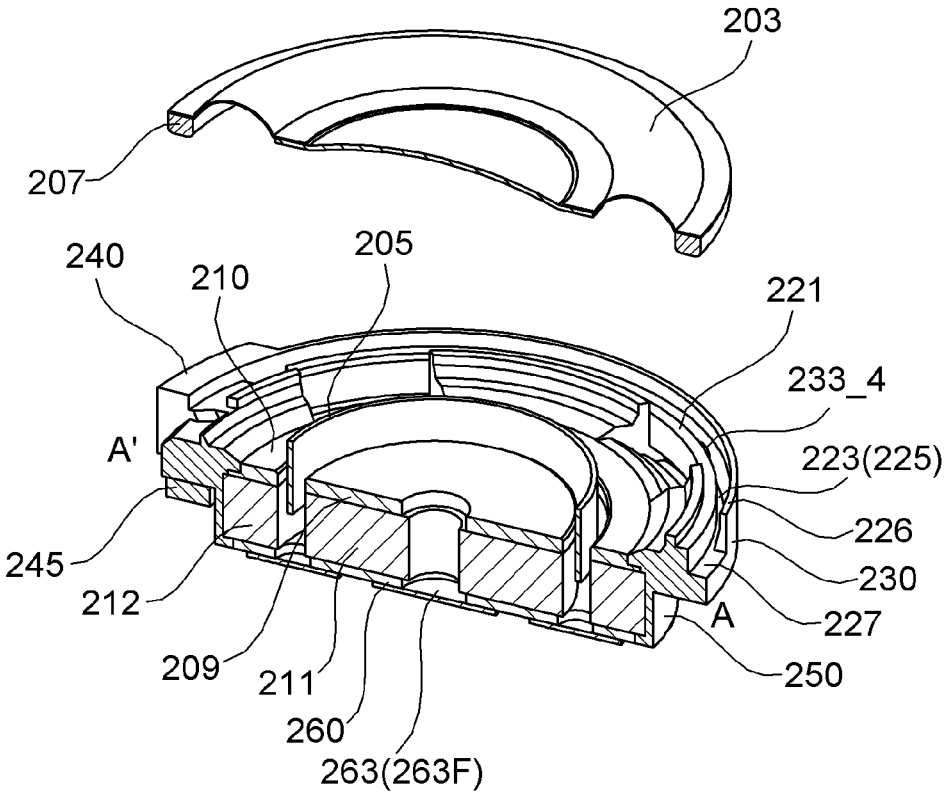

【FIG.7B】
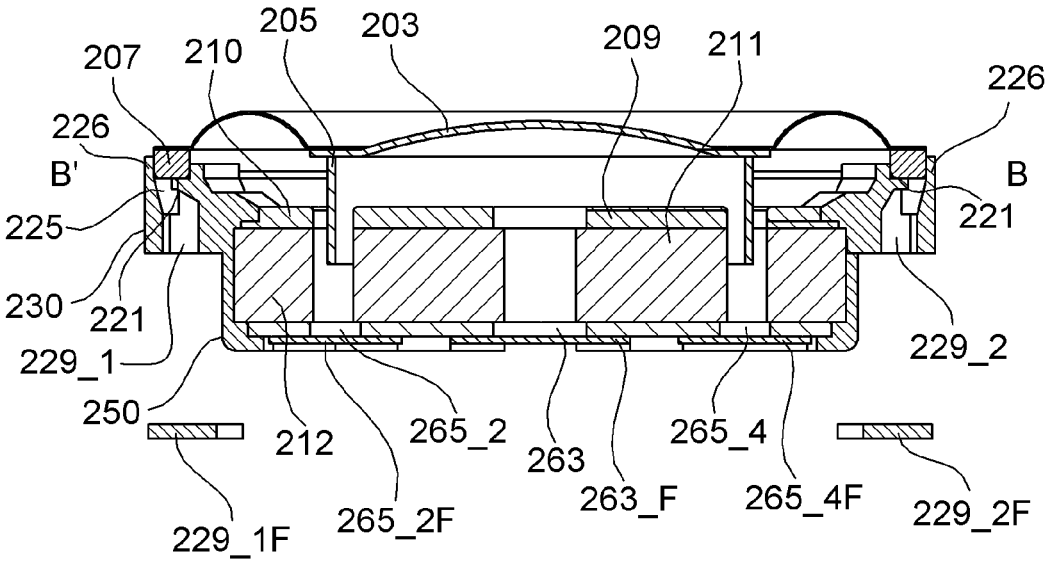

【FIG.7C】
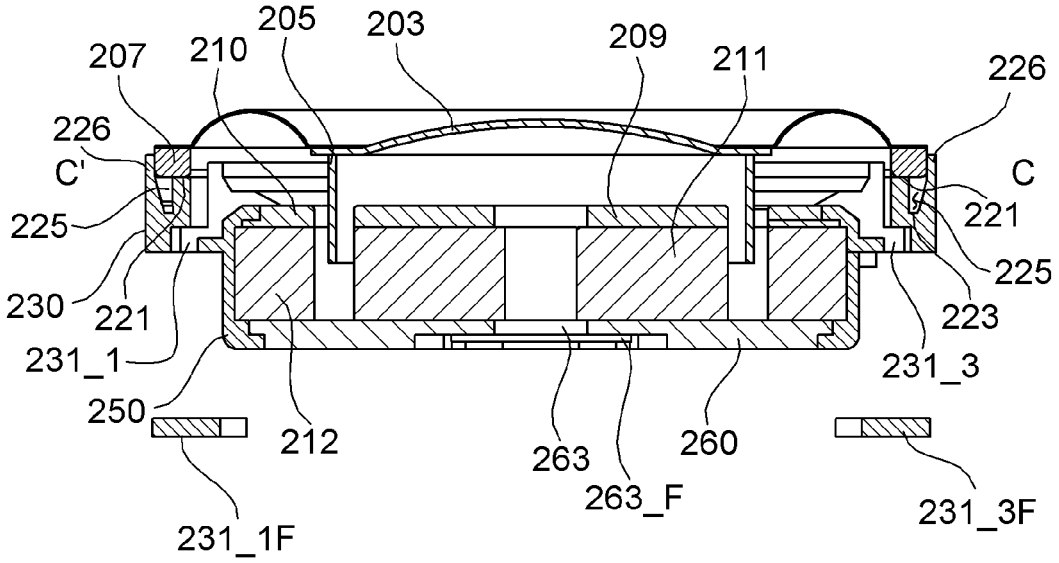

[FIG.8]
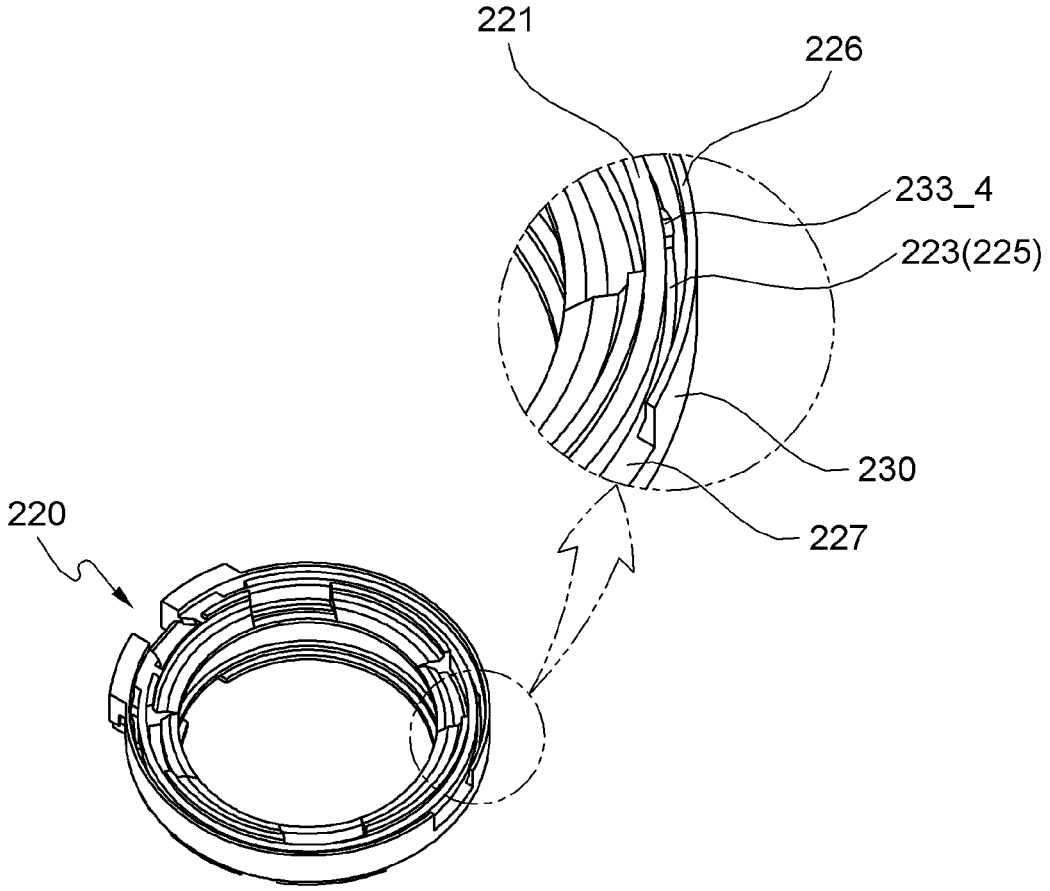

【FIG.9】
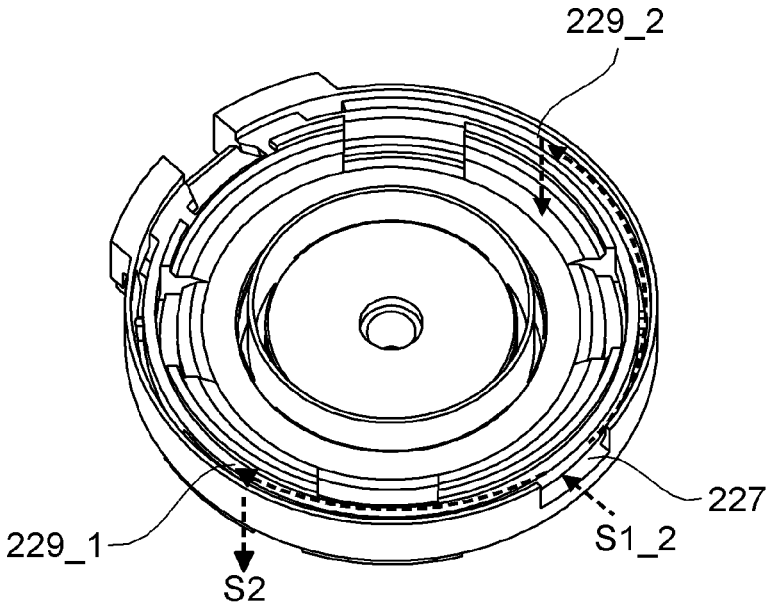
【FIG.10】
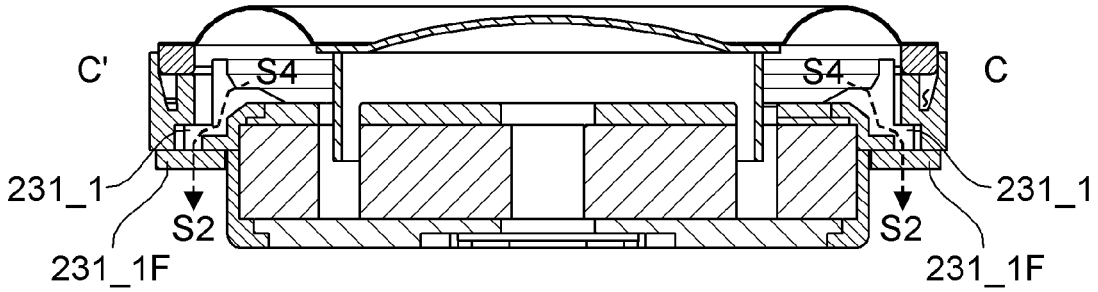

【FIG.11】
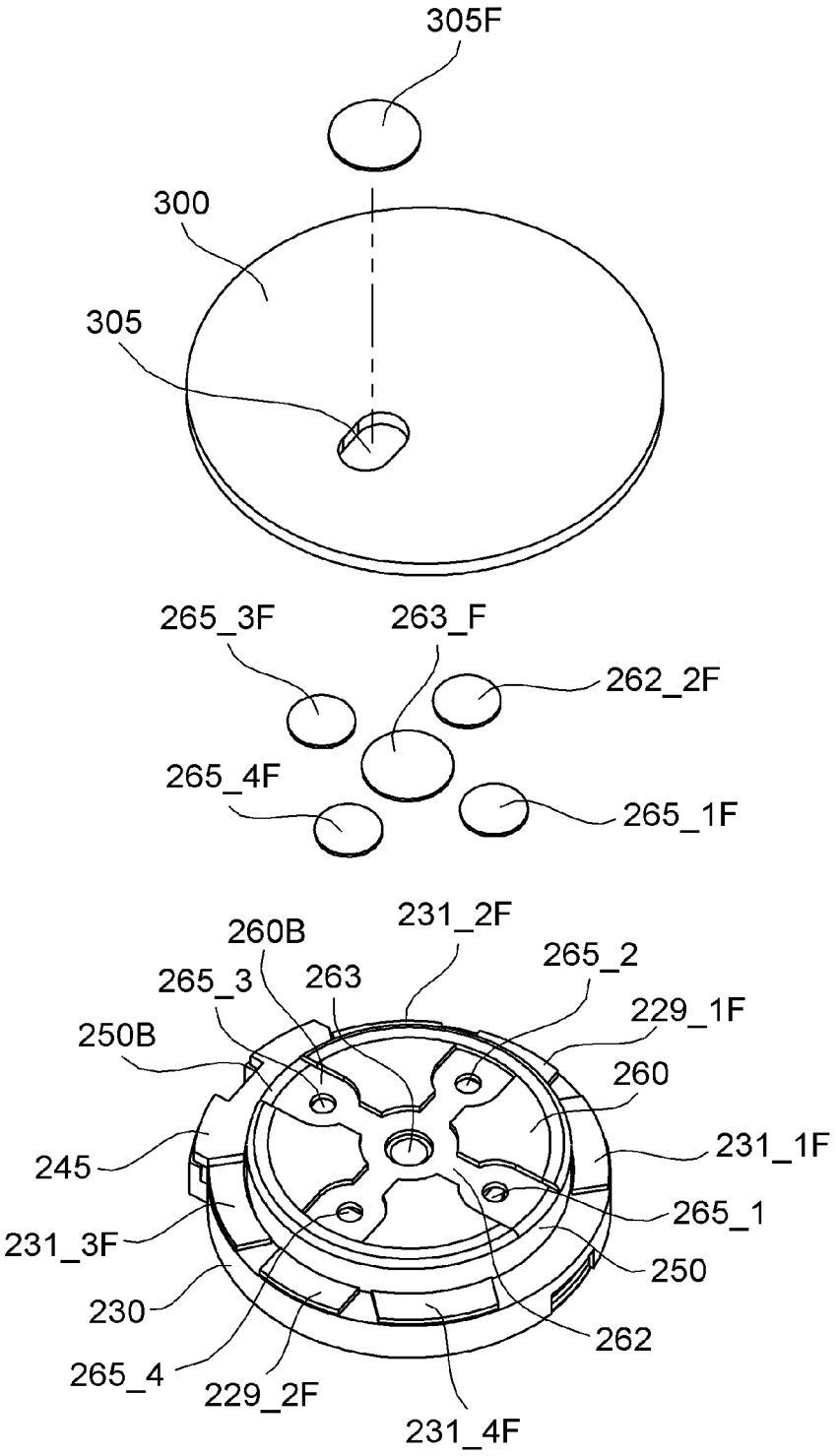

【FIG.12】
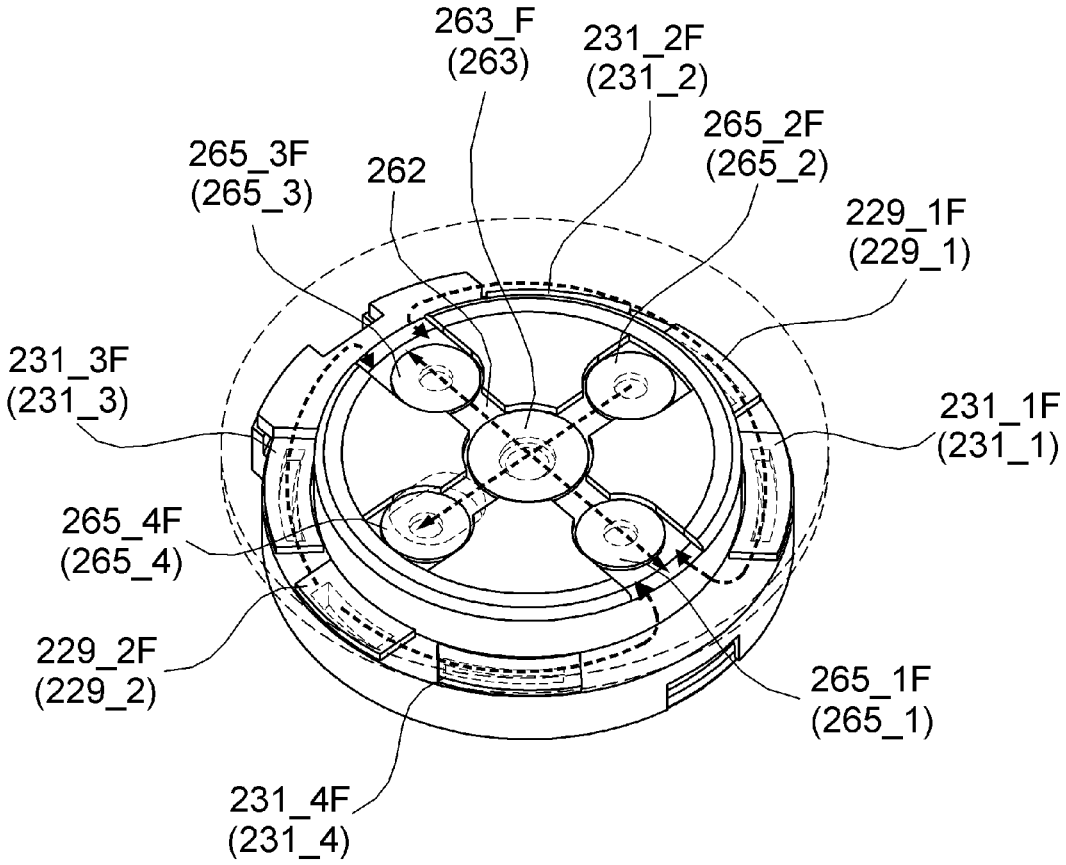

【FIG.13】
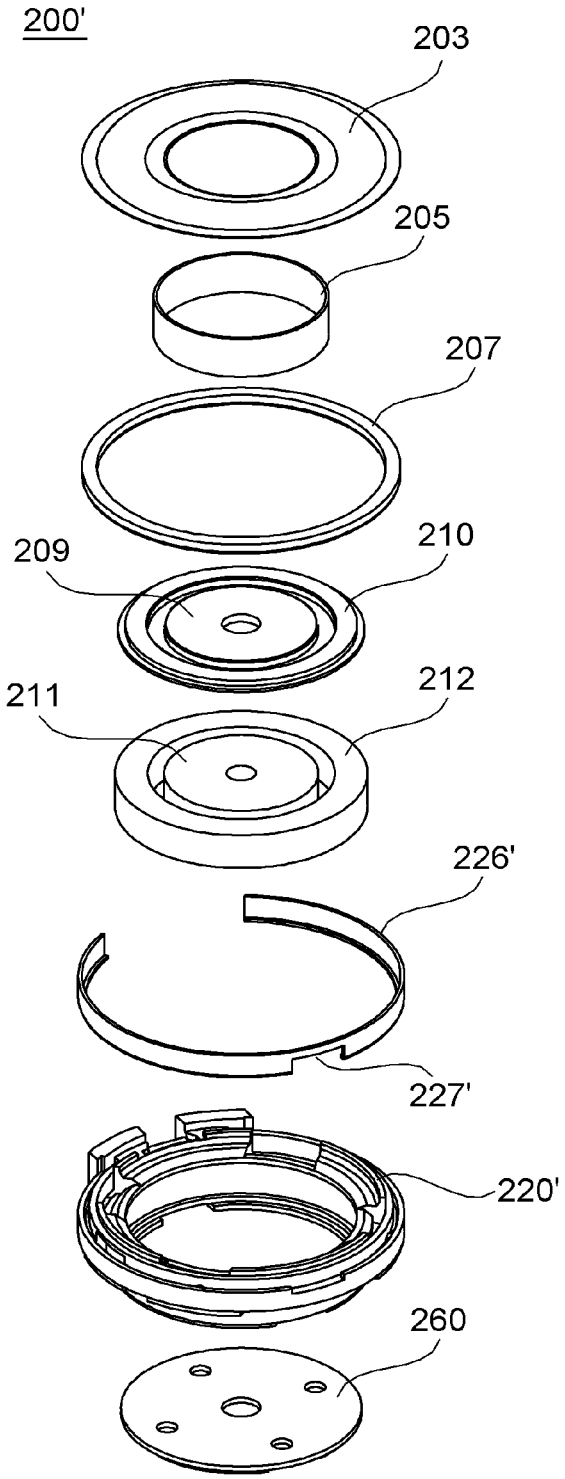

【FIG.14A】
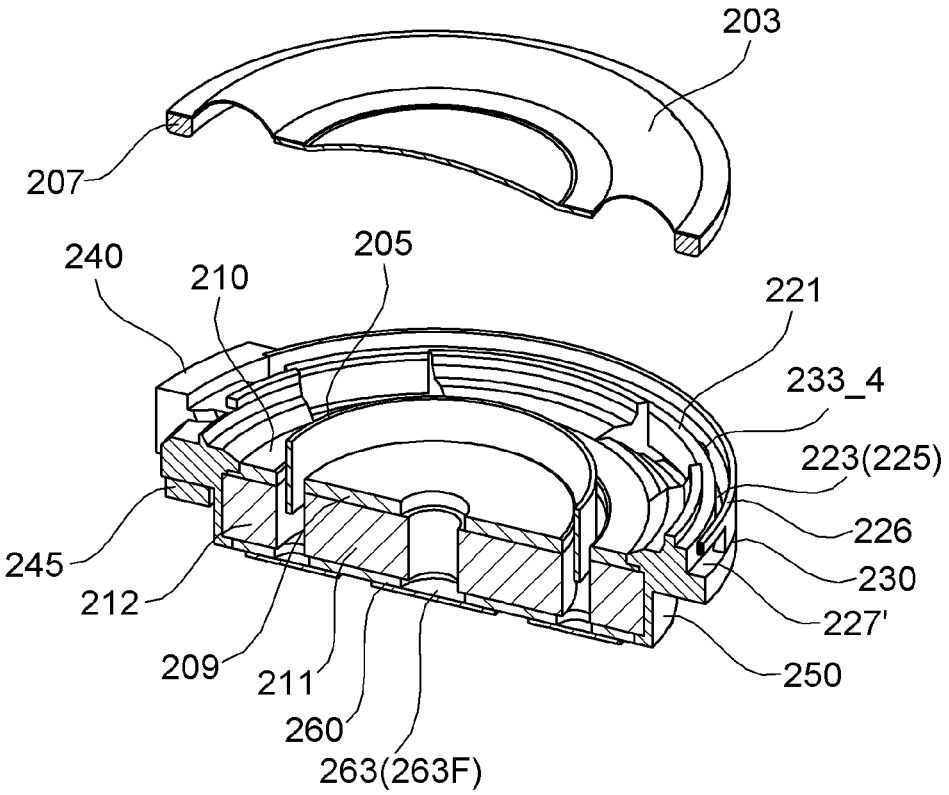

【FIG.14B】
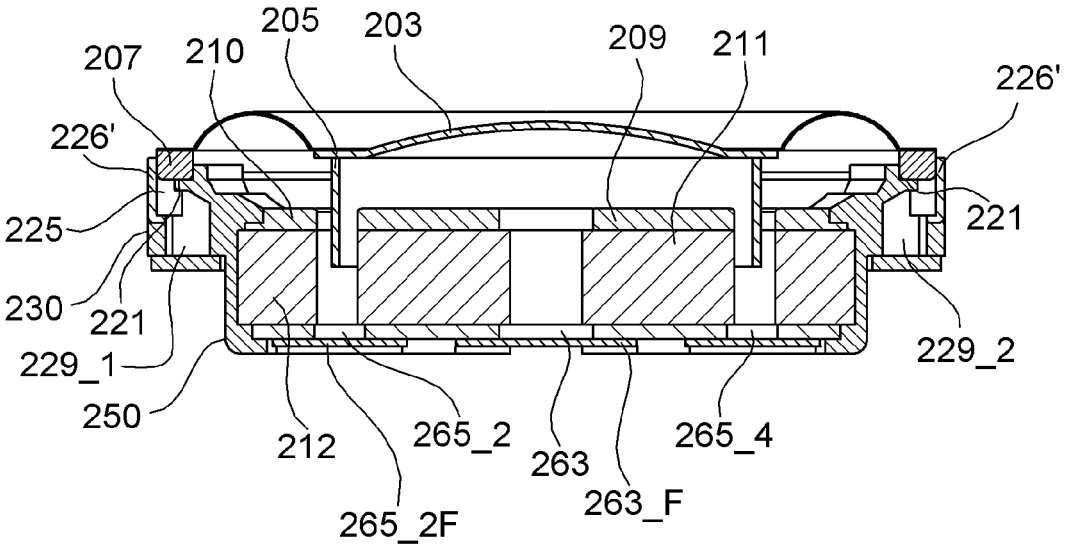

【FIG.14C】
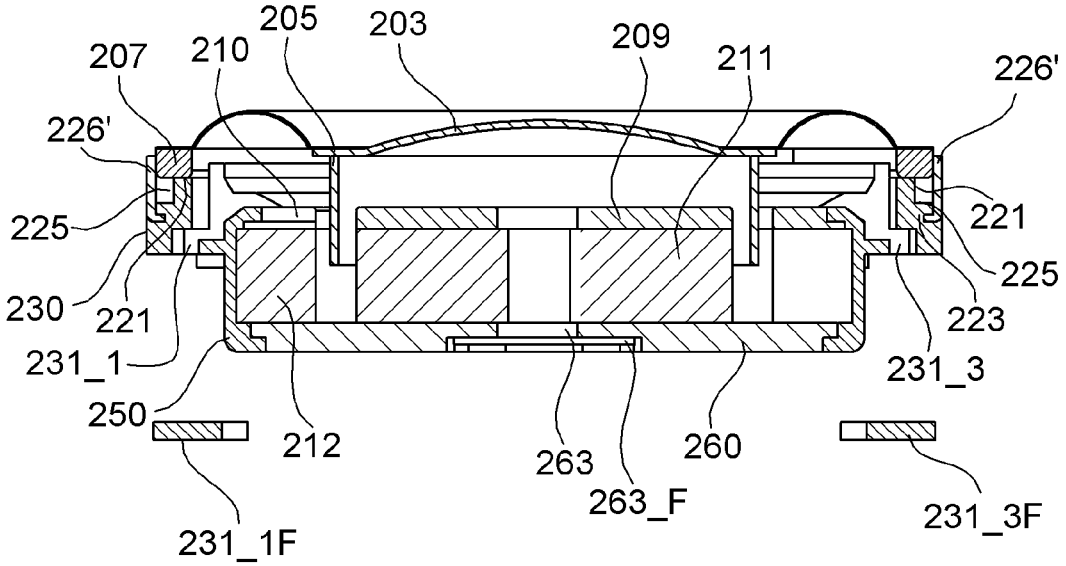

SPEAKER UNIT FOR EARPHONE

CROSS-REFERENCE TO RELATED APPLICATION

This application claims priority to and the benefit of Korean Patent Application No. 2020-0031892, filed on Mar. 16, 2020, the disclosure of which is incorporated herein by reference in its entirety.

BACKGROUND

1. Field of the Invention

The present invention relates to a speaker unit, and more particularly, to a speaker unit for an earphone, which is installed in an earphone, a headset, or the like.

2. Discussion of Related Art

Generally, an earphone is an electronic device and/or additional device which includes a miniaturized speaker unit built therein and is put in an ear (for example, an external auditory meatus) of a user and capable of directly releasing a sound generated at the speaker unit toward an inside of the ear so as to allow the user to hear the sound with low power. The user may comfortably listen to music and the like without regard to ambient conditions by using the earphone being coupled to an electronic device such as a mobile communication terminal, a portable multimedia player, a tablet personal computer (PC), and the like.

However, when the earphone is put on, a space in front of the speaker unit in the earphone and the external auditory meatus of the user is sealed such that an internal pressure thereof may increase. In this case, a pressure in the external auditory meatus increases further than that of outside, the user may feel a considerable foreign feeling such as a feeling of being deafened.

Also, when the earphone is dropped in the water or water or humidity flows into the earphone while the earphone is used in the rain, not only acoustic performance is degraded but also a risk of damaging an inner circuit is present. In the case of an earphone with a built-in battery, there is a concern about occurrence of explosion or fire.

SUMMARY OF THE INVENTION

The present invention is directed to providing a speaker unit for an earphone, capable of relieving a foreign feeling when the earphone is put on by preventing a space in front of the speaker unit in the earphone from being sealed.

The present invention is also directed to providing a speaker unit for an earphone, capable of minimizing an influence of water or humidity which flows into the earphone.

Aspects of the present invention are not limited to the above-stated aspects and other unstated aspects of the present invention will be understood by those skilled in the art from a following description.

According to an aspect of the present invention, there is provided a speaker unit for an earphone. The speaker unit includes a magnet, an upper plate fixed to a top surface of the magnet, a voice coil disposed to surround outer circumferences of the magnet and the upper plate, a vibration plate disposed above the upper plate and to which the voice coil is fixed, a fixing ring on which an edge of the vibration plate is mounted, and a frame having an open top and configured to accommodate the magnet, the upper plate, and the voice coil. Here, a pipe conduit is formed in the frame along a circumferential direction. A first hole configured to come into contact and communicates with a 1_1 space disposed in front of the speaker unit and to allow a 1_2 space disposed on a side of the speaker unit to communicate with the pipe conduit is formed in at least one first position of a side surface of the frame in a circumferential direction. A second hole configured to allow the pipe conduit to communicate with a second space disposed behind the speaker unit is formed in at least one second position at a bottom of the frame in the circumferential direction.

The frame may include a mounting portion formed along a circumferential direction to allow a part of an inside of a bottom surface of the fixing ring and a groove formed along the circumferential direction to be close to the mounting portion such that the pipe conduit is formed along the circumferential direction by the groove and a part of an outside of the bottom surface of the fixing ring.

A partition having a height smaller than a depth of the groove may be formed in the groove between the first hole and the second hole.

The frame may further include a support portion configured to provide an inner surface outside the groove and to surround and support an outer circumference of the fixing ring along the circumferential direction.

A third hole configured to allow an internal space of the speaker unit to communicate with the second space may be formed in at least one third position at the bottom of the frame in the circumferential direction.

The frame may have a shape with an open bottom. Here, the speaker unit may further include a lower plate fixed to a bottom surface of the magnet and configured to cover the bottom of the frame. Also, a fourth hole and at least one fifth hole, which allow an internal space of the speaker unit to communicate with the second space, may be formed in a center of the lower plate and a part outside the center, respectively.

When a groove portion, which traverses the fourth hole and the fifth hole and extends to a side surface of the lower plate, is formed in a bottom surface of the lower plate and a support plate configured to support the speaker unit is disposed on the bottom surface of the lower plate, the pipe conduit may be formed by the groove portion and the support plate such that an internal space of the speaker unit and the second space may communicate with each other through the fourth hole, the fifth hole, and the pipe conduit.

The groove portion may be formed to have a width between the fourth hole and the fifth hole which is smaller than a width of a part of the fourth hole or the fifth hole.

The speaker unit may further include a second mesh member configured to cover the second hole and a third mesh member configured to cover the third hole.

The second hole and the third hole may be disposed in one plane, and the second mesh member and the third mesh member may be integrally formed to cover the second hole and the third hole at the same time.

The frame may further include a support portion formed of a metal and configured to provide an inner surface outside the groove and to surround and support an outer circumference of the fixing ring along the circumferential direction. Here, the first hole may be formed at the first position on a side surface of the support portion.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of an earphone according to one embodiment of the present invention;

FIG. 2 is an exploded view of the earphone according to one embodiment of the present invention;

FIG. 3 is a cross-sectional view of the earphone according to one embodiment of the present invention;

FIG. 4A is a top perspective view illustrating a speaker unit according to one embodiment of the present invention;

FIG. 4B is a bottom perspective view illustrating the speaker unit according to one embodiment of the present invention;

FIG. 5 is an exploded view of the speaker unit according to one embodiment of the present invention;

FIG. 6A is a top view illustrating the speaker unit according to one embodiment of the present invention;

FIG. 6B is a bottom view illustrating the speaker unit according to one embodiment of the present invention;

FIG. 7A is a cross-sectional perspective view illustrating the speaker unit according to one embodiment of the present invention in one direction;

FIG. 7B is a cross-sectional view illustrating the speaker unit according to one embodiment of the present invention in another direction;

FIG. 7C is a cross-sectional view illustrating the speaker unit according to one embodiment of the present invention in still another direction;

FIG. 8 is an enlarged view illustrating one part of a frame of the speaker unit according to one embodiment of the present invention;

FIG. 9 illustrates an example of a flow of air (or sound) between a 1-2 space S1_2 on a side of the speaker unit and a second space S2 therebehind in the speaker unit according to one embodiment of the present invention;

FIG. 10 illustrates an example of a flow of air (or sound) between an internal space S4 of the speaker unit and the second space S2 behind the speaker unit according to one embodiment of the present invention;

FIG. 11 illustrates a structure of coupling a bottom of the speaker unit to a support plate 300 according to one embodiment of the present invention;

FIG. 12 illustrates an example of a flow of air (or sound) at a lower part of the speaker unit according to one embodiment of the present invention;

FIG. 13 is an exploded view of a speaker unit according to a modified embodiment of the present invention;

FIG. 14A is a cross-sectional perspective view illustrating the speaker unit according to the modified embodiment of the present invention in one direction;

FIG. 14B is a cross-sectional view illustrating the speaker unit according to the modified embodiment of the present invention in another direction; and FIG. 14C is a cross-sectional view illustrating the speaker unit according to the modified embodiment of the present invention in still another direction.

DETAILED DESCRIPTION OF EXEMPLARY EMBODIMENTS

Hereinafter, exemplary embodiments of the present invention will be described in detail with reference to the drawings. Hereinafter, throughout the description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

FIGS. 1 to 3 are views of an earphone according to one embodiment of the present invention. FIG. 1 is a perspective view of the earphone according to one embodiment of the present invention, FIG. 2 is an exploded view of the earphone according to one embodiment of the present invention, and FIG. 3 is a cross-sectional view of the earphone according to one embodiment of the present invention.

An earphone 10 according to the embodiment may include a housing 100, a speaker unit 200 installed in the housing 100, and a support plate 300 installed in the housing 100 to support the speaker unit 200.

The housing 100 may be formed by coupling an upper housing 101 with an open bottom to a lower housing 102 with an open top. Although the speaker unit 200 and the support plate 300 are installed in the upper housing 101 in FIG. 3, the speaker unit 200 and the support plate 300 may be installed in the lower housing 102 or be installed throughout the upper housing 101 and the lower housing 102 according to structures of the upper housing 101 and the lower housing 102.

The upper housing 101 may include a nozzle 110 which releases a sound output from the speaker unit 200. A first mesh 120 configured to prevent an inflow of foreign substances or to tune a sound may be installed on the nozzle 110. Also, the upper housing 101 may include a tuning hole 130 configured to tune a sound and a second mesh 140 installed on the tuning hole 130.

The support plate 300 may perform a function of supporting the speaker unit 200 and function as a substrate on which a variety of circuits (for example, a communication circuit, an active noise cancellation (ANC) circuit, and the like) for operations of the earphone 10 or a battery is installed.

An internal space of the earphone 10 may be divided into a 1_1 space S1_1 disposed in front of the speaker unit 200, a 1_2 space S1_2 which comes into contact or communicates with the 1_1 space S1_1 and disposed on a side of the speaker unit 200, a second space S2 disposed behind the speaker unit 200 and disposed in front of the support plate 300, a third space S3 disposed behind the speaker unit 200 and disposed behind the support plate 300, and an internal space S4 of the speaker unit 200.

FIGS. 4A to 7C are views illustrating the speaker unit 200 according to one embodiment of the present invention. FIG. 4A is a top perspective view of the speaker unit 200, FIG. 4B is a bottom perspective view of the speaker unit 200, FIG. 5 is an exploded view of the speaker unit 200, FIG. 6A is a top view of the speaker unit 200, FIG. 6B is a bottom view of the speaker unit 200, and FIGS. 7A, 7B, and 7C are cross-sectional views illustrating the speaker unit 200 in different directions.

The speaker unit 200 according to the embodiment may include a vibration plate 203, a voice coil 205, a fixing ring 207, a first upper plate 209, a second upper plate 210, a first magnet 211, a second magnet 212, a frame 220, and a lower plate 260.

Outer diameters of the first magnet 211 and the first upper plate 209 may have approximately same circular shapes, and the first upper plate 209 may be fixed to a top surface of the first magnet 211.

The second magnet 212 and the second upper plate 210 may have inner diameters which are approximately same annular shapes and be disposed to surround the first magnet 211 and the first upper plate 209, respectively. The second upper plate 210 may be fixed to a top surface of the second magnet 212.

The voice coil 205 may be disposed such that a part of a bottom thereof is surrounded by inner circumferences of the second magnet 212 and the second upper plate 210 while surrounding outer circumferences of the first magnet 211 and the first upper plate 209. That is, the part of the bottom of the voice coil 205 is disposed between the outer circumferences of the first magnet 211 and the first upper plate 209 and the inner circumferences of the second magnet 212 and the second upper plate 210.

The vibration plate 203 is disposed above the first upper plate 209 and the second upper plate 210, and the voice coil 205 is fixed to a bottom of the vibration plate 203. An edge of the vibration plate 203 is mounted on the fixing ring 207.

The frame 220 has a shape with a top and a bottom which are open and accommodates the voice coil 205, the first upper plate 209, the second upper plate 210, the first magnet 211, and the second magnet 212. The vibration plate 203 covers the top of the frame 220, and the lower plate 260 is coupled to the frame 220 to cover the bottom of the frame 220. The lower plate 260 is fixed to bottom surfaces of the first magnet 211 and the second magnet 212. Accordingly, the frame 220 and the lower plate 260 provide an accommodation space which accommodates the voice coil 205, the first upper plate 209, the second upper plate 210, the first magnet 211, and the second magnet 212. According to embodiments, the second upper plate 210, the second magnet 212, and the lower plate 260 may be coupled with the frame 220 through insert molding, and the first magnet 211 and the first upper plate 209 may be fixed to the lower plate 260.

To allow a detailed structure of the frame 220 to be shown, FIG. 6A illustrates a top view in which the vibration plate 203 and the fixing ring 207 are eliminated for convenience. Also, FIGS. 6A and 6B illustrate sectional directions A-A', B-B, and C-C', and FIGS. 7A, 7B, and 7C are cross-sectional views of the speaker unit 200 taken along the direction A-A', the direction B-B', and the direction C-C'.

The frame 220 may include a large-diameter portion 230 located above and having a relatively larger outer diameter and a small-diameter portion 250 located below and having a relatively smaller outer diameter.

The large-diameter portion 230 may include a mounting portion 221 formed along a circumferential direction such that an inside of a bottom surface of the fixing ring 207 is partially mounted thereon. A groove 223 may be formed outside the mounting portion 221 along a circumferential direction to be adjacent to the mounting portion 221. Also, the large-diameter portion 230 may include a support portion 226 which forms an outer circumference of the large-diameter portion 230, provides an inner surface outside the groove 223, extends toward an upper part of the bottom surface of the fixing ring 207, and surrounds and supports an outer circumference of the fixing ring 207 along a circumferential direction. Accordingly, a pipe conduit 225 may be formed along a circumferential direction by the groove 223 and a part of an outside of the bottom surface of the fixing ring 207 (that is, a part of the bottom surface of the fixing ring 207 which does not come into contact with the mounting portion 221).

A first hole 227 configured to allow the pipe conduit 225 and the 1_2 space S1_2 disposed on the side of the speaker unit 200 to communicate with each other may be formed in at least one first position in a circumferential direction of a side of the large-diameter portion 230. For example, the first hole 227 may be formed at position A in a circumferential direction on the basis of FIGS. 6A and 6B and communicate with the pipe conduit 225 counterclockwise and clockwise. Although not shown in the drawings, a first mesh member which covers the first hole 227 to block an inflow of foreign substances or to tune a sound may be installed.

Meanwhile, a protruding portion 240 which protrudes from the outer circumference of the large-diameter portion 230 in a radial direction may be formed at another position in the circumferential direction of the side of the large-diameter portion 230, and a circuit board 245 which receives an electrical signal from the outside and transmits the electrical signal to the voice coil 205 may be disposed below the protruding portion 240.

A second hole 229 which allows the pipe conduit 225 and the second space S2 disposed behind the speaker unit 200 to communicate with each other may be formed in at least one second position below the large-diameter portion 230 in a circumferential direction.

For example, a 2_1 hole 229_1 and a 2_2 hole 229_2 may be formed at positions B' and B, respectively, below the large-diameter portion 230 in the circumferential direction on the basis of FIGS. 6A and 6B. The pipe conduit 225 communicates with the second space S2 disposed behind the speaker unit through the 2_1 hole 229_1 and the 2_2 hole 229_2. Consequently, the 1_1 space S1_1 in front of the speaker unit 200 communicates with the 12 space S1_2 on the side of the speaker unit 200, the 1_2 space S1_2 communicates with the pipe conduit 225 through the first hole 227, and the pipe conduit 225 communicates with the second space S2 disposed behind the speaker unit 200 through the 2_1 hole 229_1 and the 2_2 hole 229_2 such that the 1_1 space S1_1 and the second space S2 communicate with each other.

To block an inflow of foreign substances or tune a sound, a 2_1 mesh member 229_1F and a 2_2 mesh member 229_2F, which cover the 2_1 hole 229_1 and the 2_2 hole 229_2, respectively, may be installed.

In the groove 223, partitions 233 having a height lower than a depth of the groove 233 may be formed between the first hole 227 and the 2_1 hole 229_1, between the first hole 227 and the 2_2 hole 229_2, and between the 2_1 hole 229_1 and the 2_2 hole 229_2.

For example, referring to FIG. 6A, a first partition 233_1 may be formed between the first hole 227 and the 2_1 hole 2291, a fourth partition 233_4 may be formed between the first hole 227 and the 2_2 hole 229_2, and second and third partitions 233_2 and 233_3 may be formed between the 2_1 hole 229_1 and the 2_2 hole 229_2.

FIG. 8 is an enlarged view illustrating a part around the fourth partition 233_4 of the frame 220. The partitions 233 perform functions of maintaining an air pressure inside the pipe conduit 225 and blocking a fluid or foreign substances while allowing the air proceeding along the pipe conduit 225 to pass.

FIG. 9 illustrates an example of a flow of air (or a sound) between the 1_2 space S1_2 and the second space S2 formed through the first hole 227, the pipe conduit 225, and the second hole 229 in the speaker unit 200. For convenience for understanding, the vibration plate 203 and the fixing ring 207 are eliminated.

Air which flows from the 1_2 space S1_2 in contact with the 1_1 space S1_1 through the first hole 227 passes through the pipe conduit 225 to move into the second space S2 through the 2_1 hole 229_1 and passes through the pipe conduit 225 to move into the second space through the 2_2 hole 229_2. Since the first space S1, the 1_2 space S1_2, and the second space S2 communicate with one another through the first hole 227, the pipe conduit 225, and the second hole 229 such that the space in front of the speaker unit 200 is not sealed as described above, a foreign feeling caused by an increase in an internal pressure may be relieved.

Also, even when a liquid flows through the first hole 227 due to an air pressure in the pipe conduit 225 formed along the circumferential direction of the frame 220, it becomes difficult for the liquid to proceed along the pipe conduit 225 and reaches the second hole 229. In addition, the partitions 233 formed in the pipe conduit 225 make it difficult for the liquid in the pipe conduit 225 to reach the second hole 229. The first mesh member which covers the first hole 227 may prevent a liquid from flowing into the pipe conduit 225 from the first space S1 through the first hole 227. A second mesh member 229F which covers the second hole 229 may prevent a liquid from flowing into the second space S2 from the pipe conduit 225 through the second hole 229.

As described above, the first mesh member prevents a liquid from flowing into the pipe conduit 225. The air pressure in the pipe conduit 225 and the partitions 223 prevent a liquid from proceeding through the pipe conduit 225 and reaching the second hole 229. The second mesh member 229F prevents a liquid from flowing into the second space S2. Accordingly, since a liquid is almost completely prevented from flowing into the second space S2 behind the speaker unit 200, it is possible to waterproof-protect a variety of circuits, a battery, or the like installed behind the speaker unit 200 or the support plate 300.

A third hole 231 which allows the second space S2 and the inner space S4 of the speaker unit 200 to communicate with each other may be formed in at least one third position below the large-diameter portion 230 in a circumferential direction.

For example, a 3_1 hole 231_1, a 3_2 hole 231_2, a 3_3 hole 2313, and a 3_4 hole 231_4 may be formed at positions C', E, C, and G, respectively, below the large-diameter portion 230 in the circumferential direction on the basis of FIGS. 6A and 6B.

To block an inflow of foreign substances or to tune a sound, a 3_1 mesh member 231_1F, a 3_2 mesh member 231_2F, a 3_3 mesh member 231_3F, and a 3_4 mesh member 231_4F, which cover the 3_1 hole 231_1, the 3_2 hole 231_2, the 3_3 hole 231_3, and the 3_4 hole 231_4, respectively, may be installed.

FIG. 10 illustrates an example of a flow of the air (or sound) between the second space S2 and the internal space S4 of the speaker unit 200 formed by the third hole 231 in the speaker unit 200. The air in the speaker unit 200 or the sound generated by the vibration plate 203 is discharged into the second space S2 behind the speaker unit 200 through the third hole 231.

FIG. 11 illustrates a structure for coupling the bottom of the speaker unit 200 to the support plate 300.

A fourth hole 263 and fifth holes 265 for allowing the internal space S4 of the speaker unit 200 to the spaces S2 and S3 behind the speaker unit 200 to communicate with each other may be formed in a center and a part outside the center of the lower plate 260.

For example, the fourth hole 263 may be formed in the center of the lower plate 260 and a 5_1 hole 2651, a 5_2 hole 265_2, a 5_3 hole 2653, and a 5_4 hole 265_4 may be formed at equivalent intervals along a circumferential direction in different directions on the basis of the center of the lower plate 260. To block an inflow of foreign substances or to tune a sound, a fourth mesh member 263F, a 5_1 mesh member 265_1F, a 5_2 mesh member 265_2F, a 5_3 mesh member 265_3F, and a 5_4 mesh member 265_4F, which cover the fourth hole 263, the 5_1 hole 2651, the 5_2 hole 265_2, the 5_3 hole 265_3, and the 5_4 hole 265_4, may be installed.

A sixth hole 305 which communicates with at least one of the fifth holes 265, for example, the 5_4 hole 265_4, may be formed in the support plate 300. To block an inflow of foreign substances or to tune a sound, a sixth mesh member 305F which covers the sixth hole 305, may be installed.

A cross-shaped groove portion 262 which traverses the fourth hole 263, the 5_1 hole 2651, the 5_2 hole 265_2, the 5_3 hole 2653, and the 5_4 hole 265_4 and extends to a side surface of the lower plate 260 may be formed in a bottom surface of the lower plate 260.

A bottom surface 250A of an edge of the small-diameter portion 250 and a bottom surface 260A of a part where the groove portion 262 of the lower plate 260 is not formed are disposed in one plane while a part 250B of the bottom surface 250A of the small-diameter portion 250, which corresponds to side surfaces of the 5_1 hole 265_1 and the 5_3 hole 265_3 of the lower plate 260, and a bottom surface 260B, in which the groove portion 262 of the lower plate 260 is formed, are disposed in one plane. Accordingly, when the support plate 300 is disposed below the lower plate 260, that is, the support plate 300 is disposed to come into contact with the bottom surface 250A of the edge of the small-diameter portion 250 and the bottom surface 260A of the part of the lower plate 260 where the groove portion 262 is not formed, a cross-shaped pipe conduit limited by the groove portion 262 and the support plate 300 is formed and sides of the 5_1 hole 265_1 and the 5_3 hole 2653 in the pipe conduit communicate with the second space S2. Meanwhile, the pipe conduit communicates with the third space S3 through the sixth hole 305.

Ultimately, the internal space S4 of the speaker unit 200 communicates with the second space S2 through the pipe conduit formed by the fourth hole 263, the 5_1 hole 2651, the 5_2 hole 265_2, the 5_3 hole 2653, the 5_4 hole 265_4, and the groove portion 262 and communicates with the third space S3 through the 5_2 hole 265_2 and the sixth hole 305 of the support plate 300.

As shown in FIG. 11, in the groove portion 262, a width between the fourth hole 263 and the 5-1 hole 2651, a width between the fourth hole 263 and the 5_2 hole 265_2, a width between the fourth hole 263 and the 5_3 hole 2653, and a width between the fourth hole 263 and the 5_4 hole 2654 may be smaller than widths of the fourth hole 263, the 5_1 hole 265_1, the 5_2 hole 265_2, the 5_3 hole 265_3, and the 5_4 hole 265_4. Thus, in the pipe conduit formed by the groove portion 262, the air (or sound) may be allowed to more easily flow between the fourth hole 263 and the 5_1 hole 2651, between the fourth hole 263 and the 5_2 hole 265_2, between the fourth hole 263 and the 5_3 hole 2653, and between the fourth hole 263 and the 5_4 hole 265_4.

FIG. 12 illustrates an example of a flow of air (or sound) below the speaker unit 200.

The sound discharged through the 2_1 hole 2291, the 2_2 hole 229_2, the 3_1 hole 23_1, the 3_2 hole 231_2, the 3_3 hole 231_3, and the 3_4 hole 231_4 below the small-diameter portion 250 flows into the pipe conduit formed by the groove portion 262. The sound discharged through the fourth hole 263, the 5_1 hole 265_1, the 5_2 hole 2652, the 5_3 hole 2653, and the like of the lower plate 260 is discharged into the second space S2 through the pipe conduit formed by the groove portion 262. The sound which flows into the groove portion 262 and the sound discharged through the 5_2 hole 265_2, the fourth hole 263, and the like flows again into the internal space S4 of the speaker unit 200 through the 5_4 hole 265_4 of the lower plate 260 or is discharged into the third space S3 through the sixth hole 305 of the support plate 300.

As described above, since a discharge path and an inflow path of a sound (air) are asymmetrically and diversely formed below the speaker unit 200, a frequency feature is improved, for example, a frequency band is increased such that a sound which is rich and close to an original sound may be reproduced.

FIGS. 13 to 14C are views illustrating a speaker unit 200' according to a modified embodiment of the present invention. FIG. 13 is an exploded view of the speaker unit 200', FIG. 14A is a cross-sectional perspective view of the speaker unit 200' corresponding to FIG. 7A, FIG. 14B is a cross-sectional view of the speaker unit 200' corresponding to FIG. 7B, and FIG. 14C is a cross-sectional view of the speaker unit 200' corresponding to FIG. 7C.

In the speaker unit 200 of the above-described embodiment, it is necessary to form the support portion 226 of the frame 220 to have a considerably small thickness in a radial direction. Accordingly, when the frame 220 is injection-molded such that the support portion 226 is integrally formed, it is apprehended that a molding failure occurs or the support portion 226 is damaged during a process of assembling the speaker unit 200.

To redeem this, according to the modified embodiment of the present invention, a support portion 226' separately molded using a metal material having higher rigidity than that of a frame 220' may be coupled, instead of the support portion 226, to the frame 220' formed by eliminating the support portion 226 from the frame 220. A first hole 227' corresponding to the first hole 227 may be formed at least one first position in a circumferential direction of a side surface of the support portion 226'. Like the support portion 226, the support portion 226' also provides an inner surface outside the groove 223 and surrounds and supports the outer circumference of the fixing ring 207 along a circumferential direction. The support portion 226' may be formed to have a radial cross section having an L shape. The support portion 226' and the frame 220' may be coupled to each other through insert-injection molding.

According to the embodiments of the present invention, a variety of mesh members such as the 2_1 mesh member 229_1F, the 2_2 mesh member 229_2F, the 3_1 mesh member 231_1F, the 3_2 mesh member 231_2F, and the like are installed in holes below the large-diameter portion 230 of the frame 220. It may be inconvenient to install the variety of mesh members one by one in each hole. Accordingly, when two (or two or more) holes are disposed in one plane, it is possible to eliminate such inconvenient operation by installing a mesh member having a size capable of covering the two holes at one time. In this case, protruding ribs may be formed around the holes and between the holes and the mesh member may be attached to the protruding ribs through thermosetting.

For example, referring to FIG. 6B, instead of the 2_1 mesh member 229_1F and the 3_1 mesh member 231_1F which are separate from each other, a mesh member formed by integrating the 2_1 mesh member 229_1F and the 3_1 mesh member 231_1F with each other may be provided and installed to cover the 2_1 hole 229_1 and the 3_1 hole 231_1 at the same time. In this case, protruding ribs may be formed around and between the 2_1 hole 229_1 and the 3_1 hole 231_1 of the bottom surface of the large-diameter portion 230 such that the mesh member may be attached to the protruding ribs through thermosetting. In addition, a mesh member having an approximately annular shape may be provided and installed to cover the 3_2 hole 231_2, the 2_1 hole 2291, the 3_1 hole 2311, the 3_4 hole 231_4, the 2_2 hole 229_2, and the 3_3 hole 231_3 at the same time.

According to the embodiments of the present invention, a speaker unit for an earphone may relieve a foreign feeling when the earphone is put on by preventing a space in front of the speaker unit in the earphone from being sealed.

Also, the speaker unit may minimize an influence even when water or humidity flows into the earphone.

The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but in a descriptive view. The scope of the present invention will be shown in the utility model registration claims not in the above description, and all differences within an equivalent range thereof should be construed as being included in the present invention.

What is claimed is:

1. A speaker unit for an earphone, comprising:

a magnet;

an upper plate fixed to a top surface of the magnet;

a voice coil disposed to surround outer circumferences of the magnet and the upper plate;

a vibration plate disposed above the upper plate and to which the voice coil is fixed;

a fixing ring on which an edge of the vibration plate is mounted; and a frame having an open top and configured to accommodate the magnet, the upper plate, and the voice coil, wherein a pipe conduit is formed in the frame along a circumferential direction, wherein a first hole configured to come into contact and communicates with a 1_1 space disposed in front of the speaker unit and to allow a 1_2 space disposed on a side of the speaker unit to communicate with the pipe conduit is formed in at least one first position of a side surface of the frame in the circumferential direction, wherein a second hole configured to allow the pipe conduit to communicate with a second space disposed behind the speaker unit is formed in at least one second position at a bottom of the frame in the circumferential direction, wherein the frame has a shape with an open bottom, the speaker unit further comprising a lower plate fixed to a bottom surface of the magnet and configured to cover the bottom of the frame, and wherein a fourth hole and at least one fifth hole, which allow an internal space of the speaker unit to communicate with the second space, are formed in a center of the lower plate and a part outside the center, respectively.

2. The speaker unit of claim 1, wherein when a groove portion which traverses the fourth hole and the fifth hole and extends to a side surface of the lower plate is formed in a bottom surface of the lower plate and a support plate configured to support the speaker unit is disposed on the bottom surface of the lower plate, a pipe conduit is formed by the groove portion and the support plate such that the internal space of the speaker unit and the second space communicate with each other through the fourth hole, the fifth hole, and the pipe conduit.

3. The speaker unit of claim 2, wherein the groove portion is formed to have a width between the fourth hole and the fifth hole which is smaller than a width of a part of the fourth hole or the fifth hole.

4. A speaker unit for an earphone, comprising:

a magnet;

an upper plate fixed to a top surface of the magnet;

a voice coil disposed to surround outer circumferences of the magnet and the upper plate;

a vibration plate disposed above the upper plate and to which the voice coil is fixed;

a fixing ring on which an edge of the vibration plate is mounted; and a frame having an open top and configured to accommodate the magnet, the upper plate, and the voice coil, wherein a pipe conduit is formed in the frame along a circumferential direction, wherein a first hole configured to come into contact and communicates with a 1_1 space disposed in front of the speaker unit and to allow a 1_2 space disposed on a side of the speaker unit to communicate with the pipe conduit is formed in at least one first position of a side surface of the frame in the circumferential direction, wherein a second hole configured to allow the pipe conduit to communicate with a second space disposed behind the speaker unit is formed in at least one second position at a bottom of the frame in the circumferential direction, wherein the frame comprises a mounting portion formed along the circumferential direction to allow a part of an inside of a bottom surface of the fixing ring and a groove formed along the circumferential direction to be close to the mounting portion such that the pipe conduit is formed along the circumferential direction by the groove and a part of an outside of the bottom surface of the fixing ring, wherein the frame further comprises a support portion formed of a metal and configured to provide an inner surface outside the groove and surround and support an outer circumference of the fixing ring along the circumferential direction, and wherein the first hole is formed at the first position on a side surface of the support portion.

* * * * *